US007523608B2

(12) United States Patent
Shapiro et al.

(10) Patent No.: US 7,523,608 B2
(45) Date of Patent: Apr. 28, 2009

(54) ELECTRICALLY DRIVEN MICROFLUIDIC PUMPING FOR ACTUATION

(75) Inventors: Benjamin Shapiro, Washington, DC (US); Elisabeth Smela, Silver Spring, MD (US)

(73) Assignee: University of Maryland, College Park, MD (US)

( * ) Notice: Subject to any disclaimer, the term of this patent is extended or adjusted under 35 U.S.C. 154(b) by 289 days.

(21) Appl. No.: 11/221,967

(22) Filed: Sep. 9, 2005

(65) Prior Publication Data

US 2006/0056997 A1 Mar. 16, 2006

Related U.S. Application Data

(60) Provisional application No. 60/608,838, filed on Sep. 10, 2004.

(51) Int. Cl.
*G01N 27/453* (2006.01)
*F16K 31/02* (2006.01)

(52) U.S. Cl. ..... 60/326; 204/600

(58) Field of Classification Search ..... 60/326; 204/600, 450

See application file for complete search history.

(56) References Cited

U.S. PATENT DOCUMENTS

| | | | | |
|---|---|---|---|---|
| 6,019,882 | A | 2/2000 | Paul et al. | |
| 6,106,245 | A * | 8/2000 | Cabuz | 417/322 |
| 6,277,257 | B1 | 8/2001 | Paul et al. | |
| 6,406,605 | B1 * | 6/2002 | Moles | 204/600 |
| 6,572,749 | B1 | 6/2003 | Paul et al. | |
| 6,719,535 | B2 | 4/2004 | Rakestraw et al. | |
| 6,770,183 | B1 | 8/2004 | Heneken et al. | |
| 6,869,275 | B2 * | 3/2005 | Dante et al. | 417/322 |
| 6,881,039 | B2 | 4/2005 | Corbin et al. | |
| 7,217,351 | B2 * | 5/2007 | Krumme | 204/600 |

OTHER PUBLICATIONS

Shulin Zeng et al., Electroosmotic flow pumps with polymer frits; Elsevier; Sensors and Actuators B 82 (2002) 209-212.

* cited by examiner

*Primary Examiner*—Thomas E Lazo
(74) *Attorney, Agent, or Firm*—Dykema Gossett PLLC

(57) ABSTRACT

An actuator cell includes a supply chamber containing fluid, and an expansion chamber for receiving fluid from the supply chamber, and being expandable to deform a predetermined area of the actuator cell. The actuator cell further includes a channel providing a fluid flow passage between the supply and expansion chambers, and a compliant material substantially surrounding the supply chamber, the expansion chamber and/or the channel. An electric circuit applies an electric field adjacent the supply and expansion chambers, and thereby causes fluid flow from the supply to the expansion chamber.

14 Claims, 10 Drawing Sheets

ELECTRICALLY DRIVEN MICROFLUIDIC PUMPING FOR ACTUATION

RELATED APPLICATIONS

This application claims benefit of priority of Provisional Application Ser. No. 60/608,838 filed Sep. 10, 2004, hereby incorporated by reference in its entirety.

BACKGROUND OF INVENTION a. Field of Invention

The invention relates generally to actuators, and, more particularly, to an actuation apparatus and method utilizing electrically driven fluidic pumping for generating large stresses and strains.

b. Description of Related Art

Fluids in a channel can be pumped by the application of an electric field across the channel. The physical mechanism depends on the fluid, the size of the field, the geometry of the channel holding the fluid, and the frequency of the electric field. Among the many mechanisms are electro-osmosis (EO), electro-hydro-dynamic (EHD) pumping, and dielectrophoresis (DEP). These will be introduced briefly below. The invention can make use of any electric-field driven pumping mechanism, although electro-osmosis is preferred.

Electro-Osmosis This technique is used to pump fluids that contain some quantity of charged species, such as positive and negative ions produced by dissolving salt in a liquid. It is known in the art that most solid surfaces acquire a surface electric charge when brought into contact with a liquid. The surface charging mechanisms include, for example, ionization, ion adsorption, and ion dissolution. These mechanisms occur naturally, and their strength depends upon both the solid and liquid materials, as well as the surface preparation. The surface charge attracts counter-ions to the solid/liquid interface, thus creating a thin "Debye" electric double-layer. When an electric field is applied across the liquid, the ions in the Debye layer migrate in the field, dragging the remainder of the fluid with them by means of viscous forces. This effect is referred to as electroosmosic pumping, or EOF pumping, and is a phenomena that is well known in the art of microfluidics for pumping liquids, typically for transporting liquids in micro-scale applications where the size of this effect is significant due to the large surface to volume ratio.

Specifically, referring to related-art FIG. 1, electroosmotic pumping is illustrated for a channel 10. As shown, ions 12 in liquid 14, shown as (+) charges, collect at interface 15 between the channel wall and the liquid to cancel the (in this example negative) solid surface charges 16. These charges that collect at the interface are referred to as counter-ions, and the opposite charges in fluid 22 are referred to a co-ions. An applied electric field 18 causes the positive counter-ions to move in direction 20, along the electric field, and thus drag along the fluid in the channel by viscous forces. In the center of the channel, there remain almost as many counter-ions as there are oppositely charged co-ions.

The applied field can be either DC (direct current, or constant) or AC (alternating current, or oscillating). Most EO pumping is done at DC, but when high voltages are applied, AC frequencies are advantageous because they reduce or eliminate electrolysis. However, AC pumping is more complex and is frequency-dependent.

In EO pumping, the ratio between the surface forces and the bulk (or volume) forces is important. In general, the higher the surface to volume ratio, the greater the pumping force (provided that the dimensions are not so small that the Debye layers of the walls overlap). Channels can be of arbitrary shape, having cross-sections that are round, oval, square, rectangular, etc. To increase the amount of fluid that can be pumped (and thus increase the actuator speed), while maintaining surface to volume ratios that give high pressure, the number of channels between the chambers can be increased. In addition, one dimension of the channel can be increased. For example, a narrow but deep channel can be used, since the small width dimension will ensure a high surface area to volume ratio. In addition, the channel can be filled with a porous or gel medium, creating, in effect, many parallel convoluted channels.

Electro-Hydro-Dynamic Pumping This technique, also known as ion-drag pumping, can be used to pump dielectric fluids (i.e. ones that do not conduct a current), which do not inherently contain charged species. A very high electric field is used, high enough to inject electrons from the electrodes into the fluid. The injected electrons ionize fluid molecules, making them negatively charged. These ions move toward the positively charged electrode, dragging other fluid molecules with them.

Dielectrophoresis When an electric field is applied to a polarizable particle or molecule, it develops a dipole (plus charge on one side and minus on the other). The dipole can be moved in the field if the field is asymmetric (if it is symmetric, the forces on the plus and minus simply cancel). DEP uses AC voltages. DEP effects will appear if the channel is not of uniform cross-section, or if there are changes in the material making up the channel, or through other effects that cause non-homogeneous fields.

Conventional actuators, such as motors and hydraulic actuators, are in wide use and can provide large forces and displacements. However, they are rigid, discrete units made of discrete parts. In some applications, it would be more advantageous to have actuators that are more like biological muscles, which expand and contract, come in a range of sizes and shapes, and can be conformally placed on other structures, like the muscles of the face are placed over the skull. It is of particular interest to have these artificial muscle-like materials be electrically controlled (rather than, for example, chemically controlled). Such actuators made from existing electroactive materials include piezo-electric ceramics and polymers, shape memory alloys (SMA), and dielectric elastomer actuators (DEA). Neither the conventional actuators nor the electroactive materials employ electroosmotic pumping for generation of stress and/or strain. In addition, conventional actuators and some electroactive materials cease to function if a small portion of their structure is damaged.

For all actuators, two important performance parameters are stress (force per unit area) and strain (change in length divided by the original length). Among the electroactive materials, those that are stiff (have a high Young's modulus) provide higher forces, but those that are soft can undergo large displacements.

It would therefore be of benefit to provide an actuation apparatus and method utilizing electro-osmotic pumping for generating stresses and strains that are capable of exceeding those generated by existing muscle-like actuators. It would also be of benefit to provide an actuation apparatus and method which can be produced in a variety of shapes and sizes, and either used as a stand-alone structural material or be applied over and/or within another material or structure. It would be of benefit to provide an actuation apparatus and method that can continue to function if part of the structure is damaged. It would also be of benefit to provide an actuation apparatus and method which would be applicable in a variety of fields, such as mechanics, aerodynamics etc., and an actuation apparatus and method which is robust in design, and which is relatively simple and economical to manufacture and implement.

Definitions

Stress is force per unit area and has units of Pascals.

Strain is the change in length divided by the original length, or $\Delta L/L$, and has no units; it is often given in percent.

Actuating cell means a single microfluidic pumping unit consisting of at least two chambers, a connecting channel, and electrodes. These shall also be referred to these as building blocks and unit elements.

Fluidic actuator material refers to a device consisting of a group of actuating cells that have been configured in a predetermined way.

Substrate means the material into which the chambers and channels are fabricated.

SUMMARY OF INVENTION

The present invention achieves the aforementioned exemplary objects by providing a fluid-filled actuator cell (see FIG. 2A) including a supply chamber 104, an expansion chamber 106 for receiving fluid from the supply chamber, and one or more micro-scale or nano-scale channels 108 providing a fluid flow passage between the supply and expansion chambers. By "micro-scale or nano-scale" it is meant that the smallest dimension of the channel (or pore, in a particle or gel-filled channel) is less than 100 μm and larger than 1 nm. The other dimensions can be larger. A compliant (stretchable) material forms part or all of the "walls" of the supply and reservoir chambers, making the supply and expansion chambers deformable. Fluid pressure can therefore deform a predetermined area, or areas, of the actuator cell (see FIG. 2B). An electric circuit, consisting of electrodes 114, a power supply 112, and a means 110 for switching the power on and off, may provide an electric field between the supply and expansion chambers, thereby causing fluid flow from the supply to the expansion chamber. The expansion chamber can be oriented for deforming the actuator cell in a predetermined direction.

If the chambers and the channels are formed in a rigid substrate, then a compliant membrane can be bonded over the substrate. This allows deformation of the membrane perpendicular to the rigid substrate (see FIG. 3). Alternatively, if the chambers and channels are formed in a stretchable substrate, then the substrate itself can be deformed.

The actuator cell can further include at least two expansion chambers (see FIG. 2C), with the electric circuit controlling the expansion of each chamber separately, or both together. The expansion chambers can be oriented in different directions.

Combining several cells together can produce a fluidic actuator material. The actuating cells can be used as "building blocks" to construct a "smart" material that can change continuously from one shape into another shape, or several other shapes. This fluidic actuator material can have a variety of form factors, for example a plate, cylinder, or a cube, as desired. The cells can be sized, oriented, shaped, and arranged in different ways to allow the fluidic actuator material to perform a variety of deformations, including bending, twisting, shortening, lengthening, bulging, dimpling, etc. Which of the variety of deformations the fluidic actuator material takes on, and how much it deforms, is controlled by the voltages applied to each of those cells. Preferably, the cells are small on the scale of the fluidic actuator material.

The fluidic actuator material can be a free standing structure and it can also be integrated over or within other structures, which can be non-active. The free-standing structure can be load-bearing, such as the wing of an aircraft that is able to change shape upon command. If the fluidic actuator material is integrated over a structure, then it can be used to change surface texture of that structure (for example producing small bumps on the surface in order to change the characteristics of fluid flow over the surface) or to change the shape of the surface (for example to control the expressions of an animatronic face). If the fluidic actuator material is integrated over or within a structure, then it can be used to deform or reconfigure that structure (similar to the way an insect muscle deforms the carapace, or mammalian muscles change the relative orientations of bones).

Since the fluidic actuator material consists of individual sealed actuation cells, if some of those cells are damaged, the others can continue to function. Thus, if the fluidic actuator material is punctured, for example, the rest of the device is unaffected (provided that the wiring layout of the electrodes has been designed with the appropriate redundancy).

The invention further provides a method of actuating that consists of providing an electric field between two or more chambers having compliant elements and being connected by micro- or nano-scale channels, causing fluid to be pumped from one chamber to another. The method can include applying voltages across a pair of chambers and among a plurality of chambers.

Additional features, advantages, and embodiments of the invention can be set forth or will be apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE PREFERRED EMBODIMENTS

Figure 1:
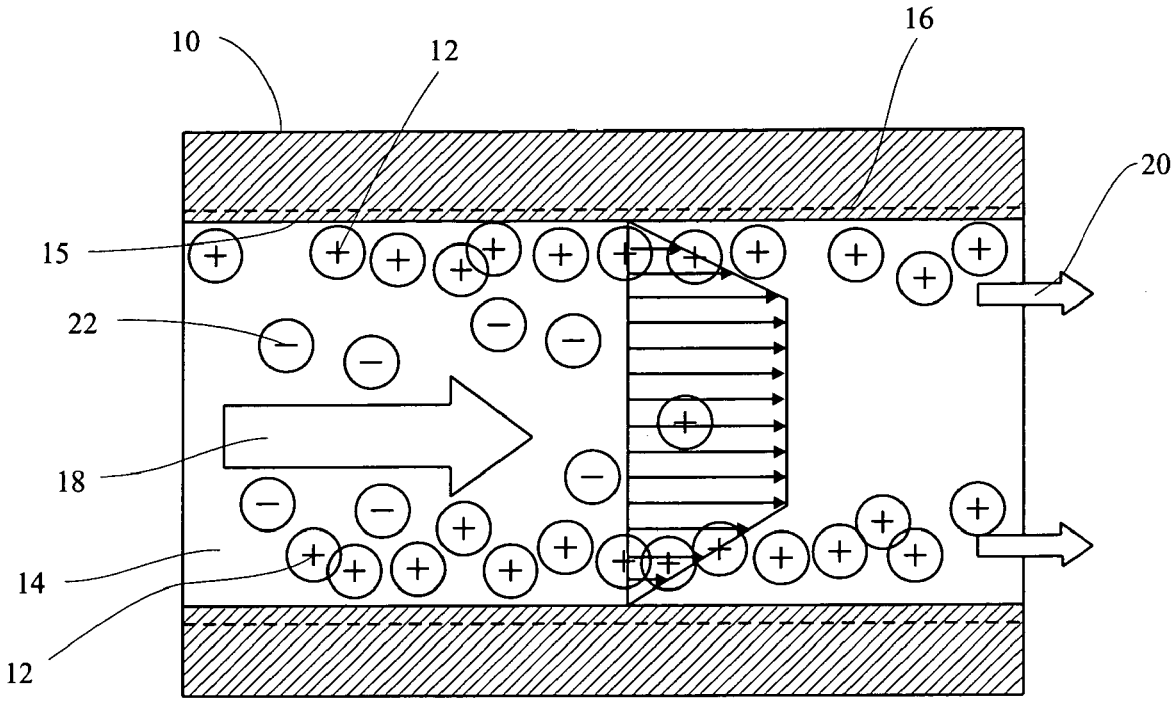
FIG. 1 is a graphic illustration of the electro-osmotic pumping phenomenon.
Figure 2A:
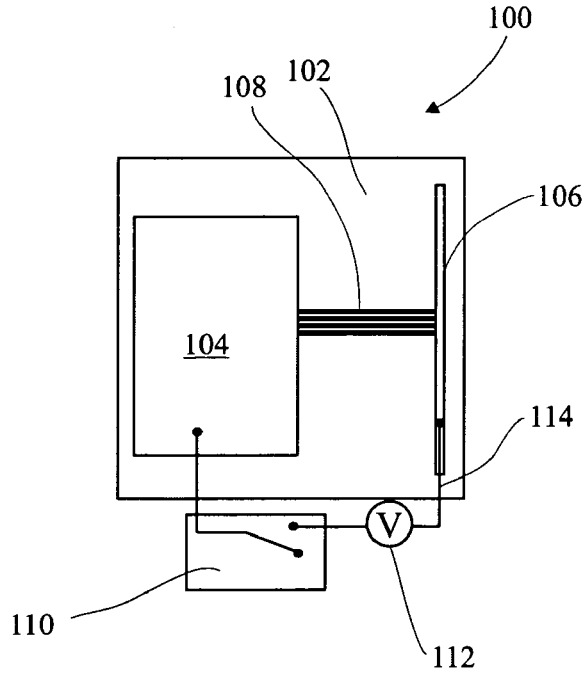
FIGS. 2A-2C are schematic diagrams of an actuator cell according to the present invention, with FIG. 2A illustrating an actuator cell including an x-direction expansion chamber in a rest configuration, FIG. 2B illustrating the actuator cell in an "actuated" or expanded configuration, and FIG. 2C illustrating an actuator cell including x and y-direction expansion chambers in a rest configuration.
Figure 2B:
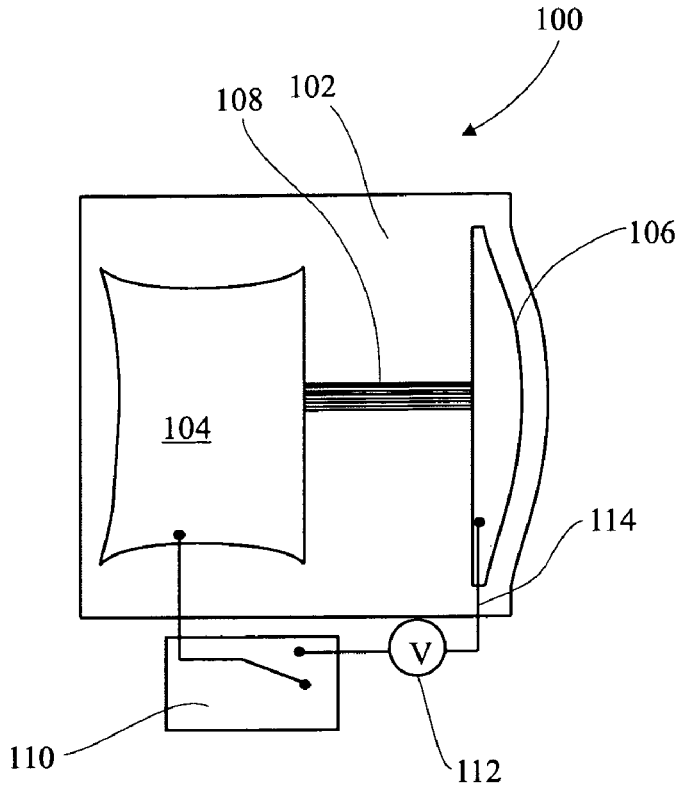
Figure 2C:
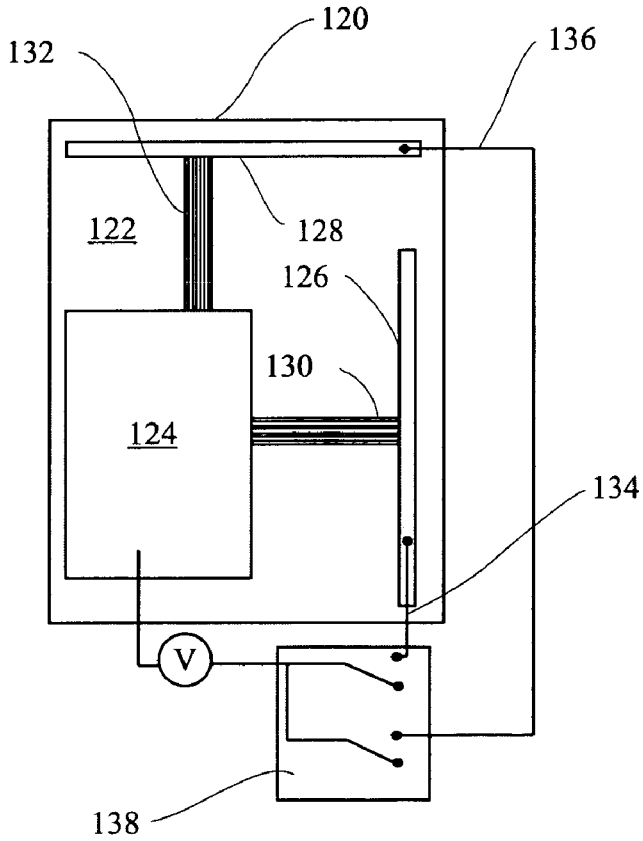
Figure 4A:
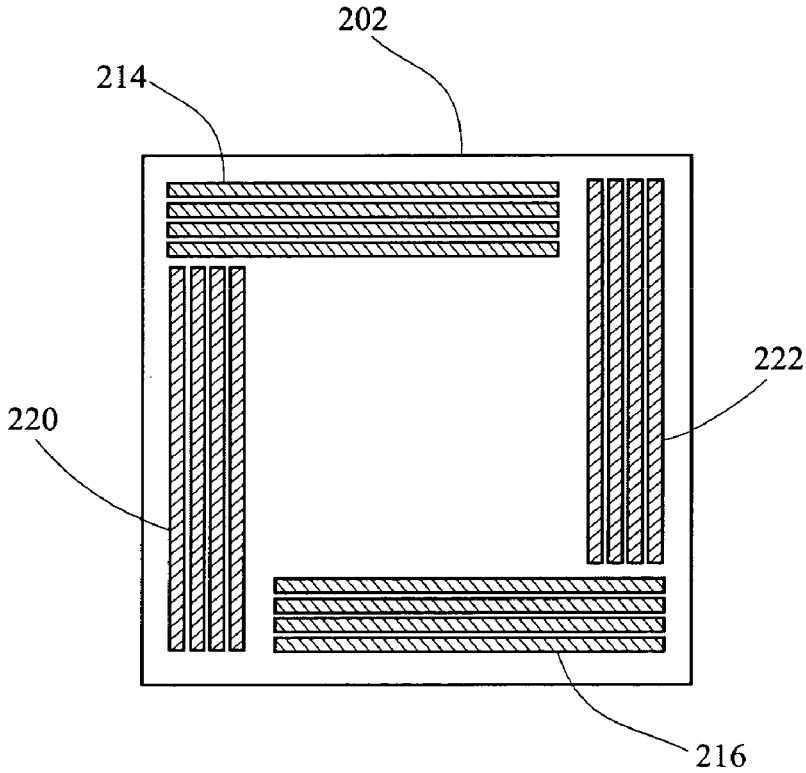
FIGS. 4A-4E are schematic diagrams showing cross-sections of a fluidic actuator material, with FIG. 4B representing the actuated configuration, and FIGS. 4C-4E illustrating various exemplary layouts for supply and expansion chambers in a fluidic actuator material.
Figure 4B:
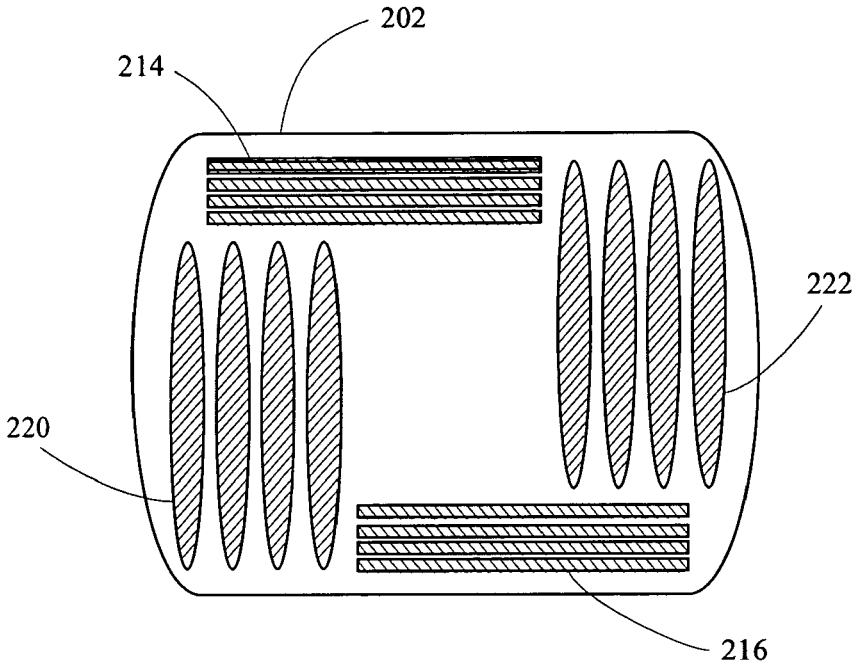
Figure 4C:
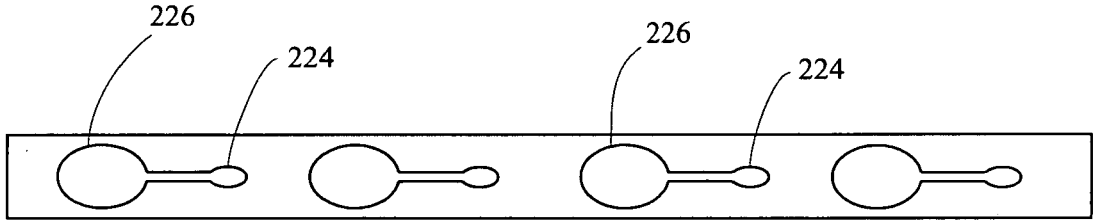
Figure 4D:
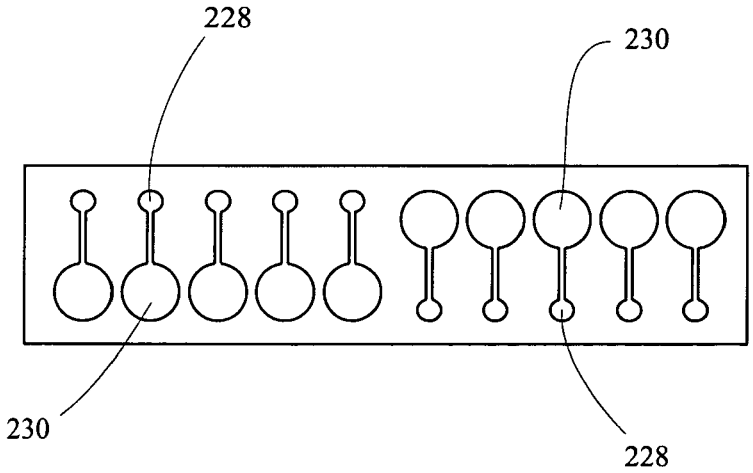
Figure 4E:
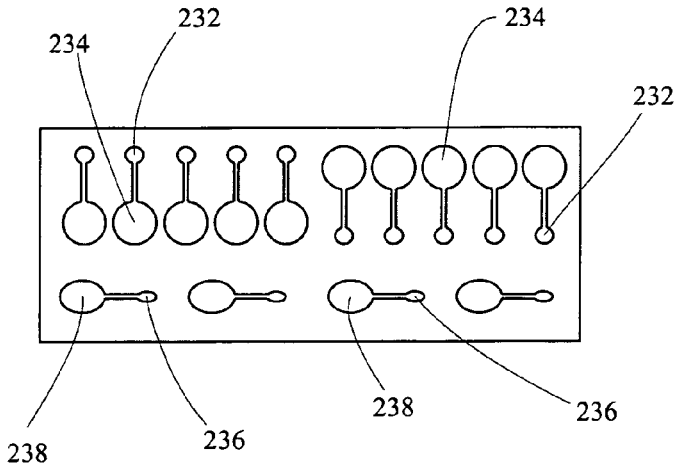
Figure 5:
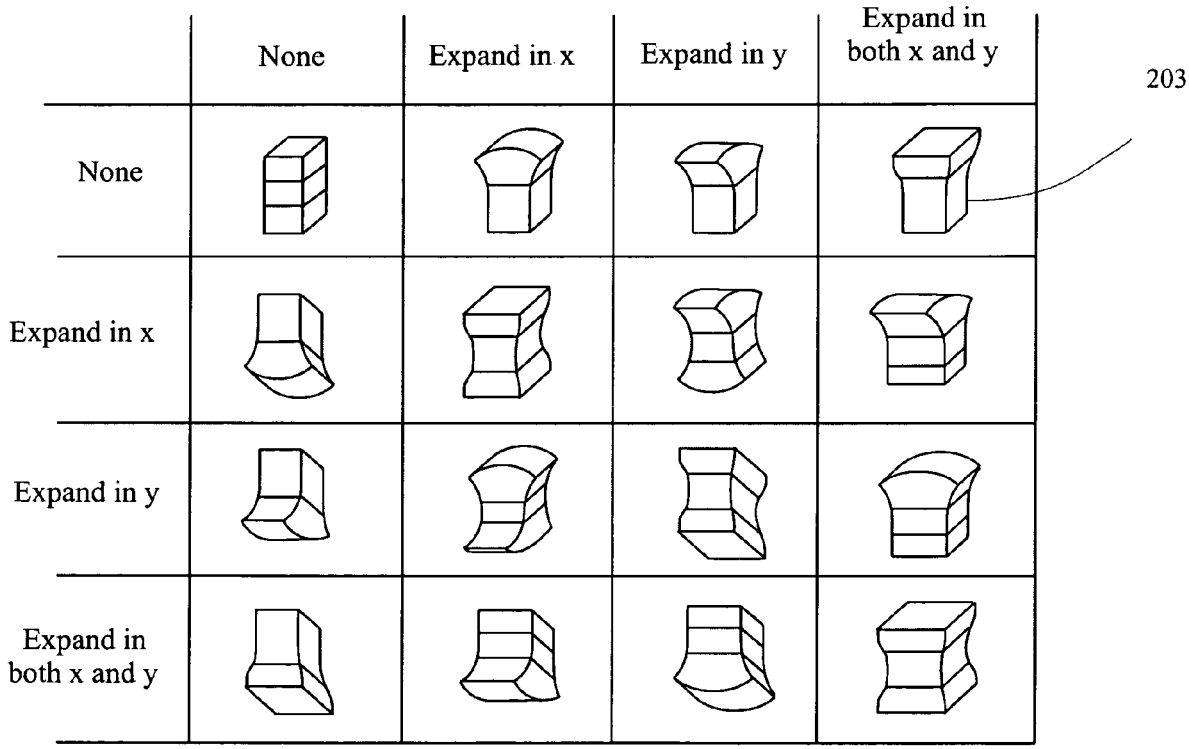
FIG. 5 illustrates the available modalities for an actuator cell according to the present invention.
Figure 6:
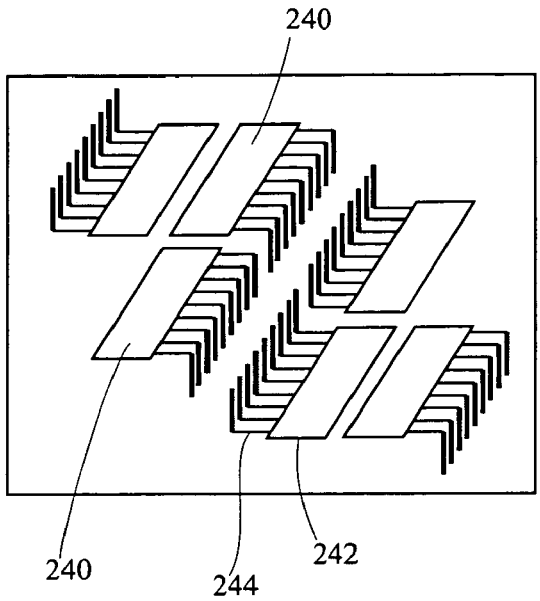
FIG. 6 illustrates an exemplary phase layout of chambers and channels for minimizing dead-space and maximizing strain in a fluidic actuator material.

Referring now to the drawings wherein like reference numerals designate corresponding parts throughout the several views, FIGS. 2A-2C illustrate an actuator cell, and FIGS. 4-6 illustrate a fluidic actuator material according to the present invention, and FIGS. 7-10 provide various other embodiments utilizing the actuator cell and related properties thereof.

Generally, the present invention provides an actuator that can exhibit both large stresses (up to tens of giga-Pascals) and large strains (up to tens of percent).

FIGS. 2A and 2B are schematic diagrams of actuator cell 100 according to the present invention, which utilizes the aforementioned electro-osmotic pumping phenomenon. As shown, actuator cell 100 includes a compliant material 102, a supply chamber 104, an expansion chamber 106, and a plurality of micro-fluidic (or nano-fluidic) channels 108 connecting supply chamber 104 to expansion chamber 106. Cell 100 further includes an electric circuit 110 for generating an electric field between chambers 104 and 106, and for thereby pumping fluid from within chamber 104 to expansion chamber 106. Electric circuit 110 is connected to supply and expansion chambers 104 and 106 as shown and includes a voltage source 112 and electrodes 114. In the particular embodiment illustrated, material 102 is configured to surround the noted elements of actuator cell 100, and can deform or stretch as cell 100 is activated by means of electric circuit 110. Fluidic channels 108 can have a smallest dimension ranging from about 5 nm to about 500 μm, the optimal range being 50 nm-50 μm. The dimensions of each of the channels can be chosen based upon the volume of the actuator cell, the required pressure that it is desired to exert, and the desired speed of actuation. The forces become progressively stronger as the smallest dimension of the channel decreases, but the pressure drop over the channel increases and the amount of fluid that can be pumped through the channel decreases (if the other dimensions remain unchanged).

In the particular embodiment illustrated, electrodes 118 are compliant. The electrodes can be compliant (stretchable), flexible (bendable), or rigid, depending on the placement of the electrodes and the materials used to construct the cells.

In operation, when an electric field is applied by means of electric circuit 110, as briefly discussed above, fluid is pumped from the supply chamber 104 via channels 108 by means of the aforementioned electroosmosic or other electrical pumping effect to expansion chamber 106, so that expansion chamber 106 becomes deformed as shown in FIG. 2B. The expansion of chamber 106 changes the shape of cell 100 as shown. The limitations on the expansion of chamber 106 can be governed by either the elastic restoring force of compliant material 102 covering the actuator cell, or by an external load that balances the pressure created in the channels. Further, in the particular embodiment illustrated, chamber 106 can expand in the x-direction so as to change the shape of cell 100 in the x-direction.

As shown in FIG. 2C, in a similar manner as in FIG. 2A, an actuator cell 120 can be formed of compliant material 122, and include a supply chamber 124, expansion chambers 126, 128, and a plurality of channels 130 and 132 that respectively connect supply chamber 124 to expansion chambers 126 and supply chamber 124 with expansion chamber 128. Compared to the FIG. 2A embodiment, electrodes 134 and 136 of electric circuit 138 can be selectively activated to expand either chamber 126, for x-directional expansion of cell 120, or chamber 128 for y-directional expansion. Of course a variety of other layouts are foreseeable for the various components of an actuator cell, as would be evident to those skilled in the art, and as discussed in greater detail below.

Figure 3:
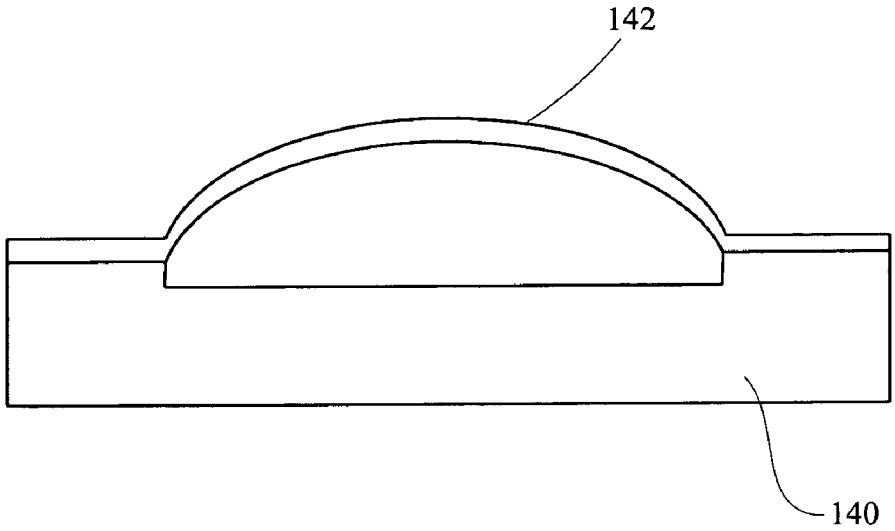
FIG. 3 is an illustration of an actuator cell including a rigid substrate and a compliant membrane.

Referring to FIG. 3, if the chambers and the channels are formed in a rigid substrate 140, then a compliant membrane 142 can be bonded over the substrate. This allows deformation of the membrane perpendicular to the rigid substrate. Alternatively, if the chambers and channels are formed in a stretchable substrate, then the substrate itself can be deformed.

FIGS. 4A and 4B illustrate a top view cross-section of an actuator cell 202. FIGS. 4A and 4B respectively depict an exemplary chamber layout and subsequent expansion of two sets of chambers 214, 216, 220, and 222. The channels and reservoirs that supply the chambers are not shown here, but can be located underneath or above these chambers. As shown in FIG. 4A, a plurality of chambers 214, 216 can cause expansion of cell 202 in the y-direction, and chambers 220, 222 can cause expansion of cell 202 in the x-direction. In the particular embodiment illustrated, the chambers can undergo a range of strains between approximately 0% and 50%, or more, in the x and/or y directions by filling each of the chambers independently and/or at the same time with various amounts of fluid. Chambers 214, 216 and/or 220, 222 can be individually addressable by means of electrodes (not shown) for expansion of the cell in the x and/or y directions. For example, chambers aligned parallel to the y direction will, when expanded by the fluid, cause cell 202 to elongate in the x direction. Conversely, the chambers oriented along the x direction will cause an expansion in the y direction.

FIGS. 4C-4E illustrate various exemplary layouts for supply and expansion chambers in a fluidic actuator material with a plate shape. For example, FIG. 4C illustrates a variety of horizontally oriented supply and expansion chambers 224, 226, respectively, FIG. 4D illustrates a variety of vertically oriented supply and expansion chambers, 228, 230, respectively, and FIG. 4E illustrates a configuration including both vertically and horizontally oriented supply and expansion chambers 232, 234, 236 and 238, respectively, with the supply and expansion chambers being variously oriented as shown.

A fluidic actuator material can be formed by roll-to-roll fabrication, and thus include repeated layers of building block actuation cell elements, with each element being continuously (i.e., in an analog manner through e.g. the magnitude of the voltage, rather than simply on-off) and individually addressable to produce a number of configurations. In a particular embodiment of the fluidic actuator material, a plate can be formed in a 0.33 m wide compliant substrate of any length using roll-to-roll fabrication.

The fluidic actuator material may be designed to consist of a plurality of identical actuation cells with top and bottom sections fed by a central supply chamber. Both top and bottom sections may be designed, as in FIG. 2C or FIG. 4A, to consist of perpendicularly oriented expansion chambers. With such a design, each top or bottom section of the unit actuation cell building element can expand continuously in the x-direction, the y-direction, or both, as shown in FIG. 5. Additionally, by choosing different modalities for the top and bottom chamber of a unit element (i.e. top expand in y, bottom does nothing; or, top expand in x, bottom expand in y) it is possible to make each element deform in a plurality of ways. Some of the available modalities for each such actuation cell 203 are shown in FIG. 5 (the central supply chamber is not shown).

As an example, referring to the (2,3) quadrant of FIG. 5, the top chamber expands in the y direction while the bottom chamber expands in the x direction to produce a twisted "anvil" shape. Further, since the deformation of each actuator cell 203 can vary continuously and since each unit element of the actuator plate can be individually addressed by the electrode network and micro-processors, it is possible to precisely choose the type and amount of deformation in each portion of the plate. As discussed above, this means that the plate as a whole can take on a large number of shapes.

The fluidic actuator material may be in the form of a plate composed of repeated 1 cm×1 cm×2 cm actuator cells 203, each of which is able to expand, bend around the x or y axis as shown in FIG. 5, or perform a combination of all three tasks with, for example, 10-15% strains, $10^6$ J/m$^3$ energy density, $10^6$ W/m$^3$ power density, and 0.5 Hz bandwidth. (These numbers depend on the number of chambers and channels and their dimensions, as well the material properties, the applied potentials, and other factors.) Since each actuator cell 203 can be individually addressable, the resulting plate can take on a large number of shapes (i.e. it can expand, twist, curl, exhibit bumps, and/or replicate a surface whose local radius of curvature is equal to or greater than about 20 cm (for the particular embodiment described above)). Moreover, since each layer of the plate would be the same, such layers would be simple and economical to fabricate and then cut into different shapes.

As discussed above, the fluidic actuator material would also be able to withstand punctures by a number of holes since each hole will only cause local "bleeding" and a loss of performance in the punctured cell. Thus, so long as the fluidic actuator material includes redundant electronics (for example parallel connections and redundant micro-processors), the actuator material will continue to function even if a fraction of its volume is damaged.

Yet further, the actuation cells are advantageous in that in the event of channel blocking by particulates and other causes, the other channels can still carry fluid. Thus, even if, for example, 10% of the channels become blocked, the achieved pressure and strain will remain essentially the same. However, the actuation rate will decrease linearly with the percentage of blocked channels. For an extreme value of 30% blocked channels, for example, the plate would still be able to achieve a stress of $10^7$ Pa, a strain of 10-30%, and an expansion rate of 2.6 seconds (up from 2.0 seconds).

Yet further, the actuator cells and the fluidic actuator material are advantageous since, once fabricated, the cells would be sealed. They would thus be essentially impervious to external conditions such as humidity, sand, salt, etc. To avoid detrimental effects due to large temperature variations, materials and fluids may be chosen whose thermal expansion coefficients are similar.

Actuator cells 100 and fluidic actuator materials can be made using microfabrication techniques and other methods known in the art. For example, cells 100 and fluidic actuator materials can be batch fabricated using microelectromechanical system (MEMS) techniques. Channels and reservoirs can be fabricated by etching or by molding, depending on the material. Compliant electrodes can be made by, for example, metal films deposited over accordion-like surface structures, elastomer films containing conducting nanoparticles, and other techniques known in the art. Electrode corrosion and electrolysis can be reduced by using AC fields.

For cells 100 and fluidic actuator materials, the chambers and channels can be shaped and oriented to optimize stress, strain, and/or speed. In addition, the layout of the actuation cells can be optimized, for example, to minimize dead-space and minimize the overall size and/or complexity of the structure.

Referring next to FIG. 6, a layout of chambers and channels for minimizing dead-space and maximizing strain in an actuator plate is illustrated. Such a pattern of chambers, channels, and electrodes can be repeated throughout an entire actuator plate. As shown in FIG. 6, the layout includes a plurality of supply chambers 240, and a plurality of expansion chambers 242 interconnected by channels 244, and the pattern repeated along the length of the actuator plate.

Figure 7:
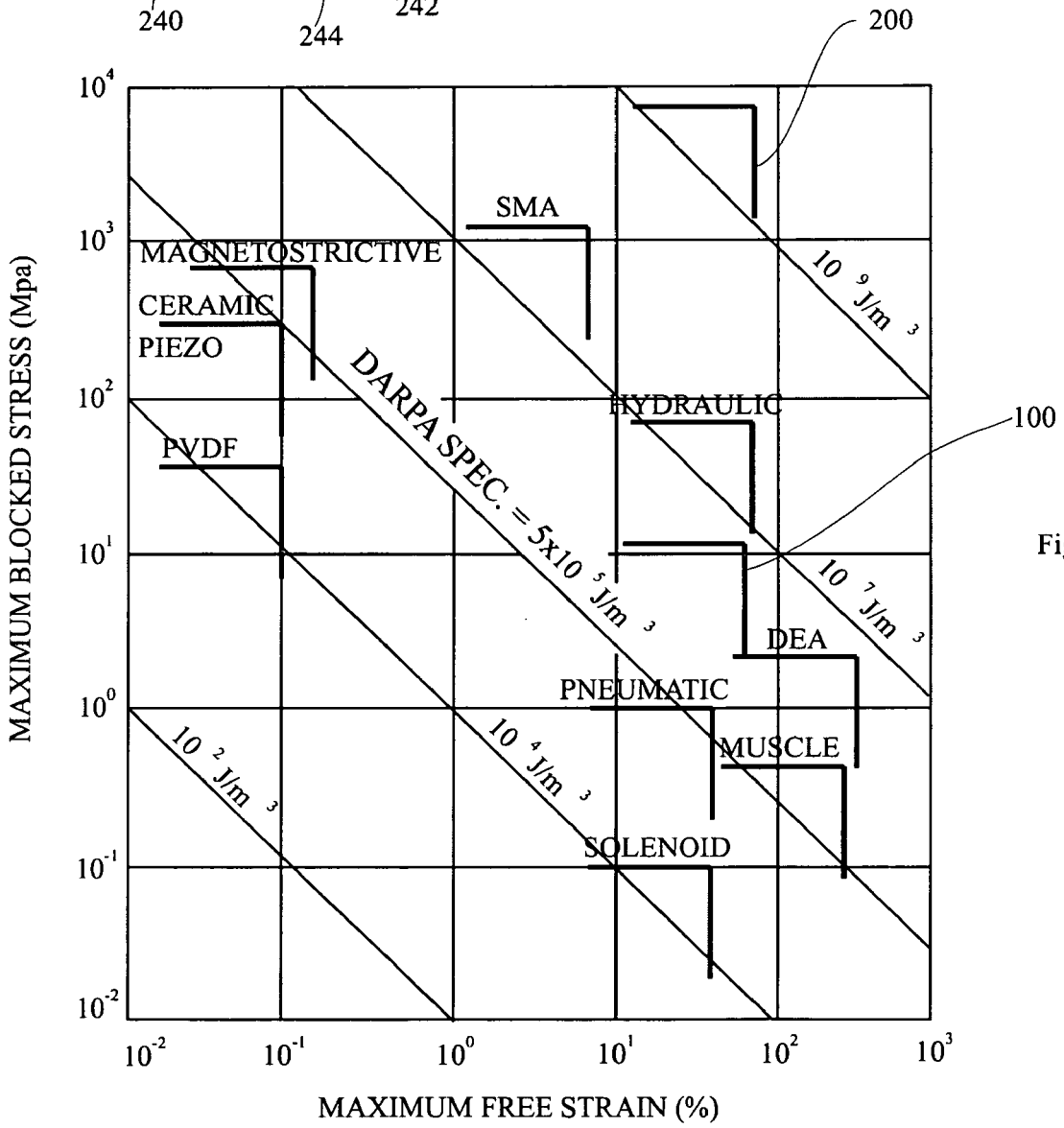
FIG. 7 is a graph of maximum blocked stress and free strain of conventional smart materials, and those of the present invention actuator cell and fluidic actuator material.

FIG. 7 illustrates maximum blocked stress and free strain of conventional smart materials versus those of the present invention.

Specifically, as shown in FIG. 7, compared to conventional smart materials and actuators such as magnetostrictive, piezoelectric, hydraulic, etc., the present invention actuator cell 100 produces significantly higher strains than shape memory alloys (SMA) and piezoelectrics, and significantly higher stresses than dielectric elastomers (DEA). Further, the present invention fluidic actuator material likewise produces stresses and strains which are well beyond those of conventional smart materials.

The various properties of electroosmotic pumping in actuator cell 100 and the fluidic actuator material will now be described in detail.

Volume Flow Rate: Material Actuation Speed

Referring to FIG. 2A, the volume flow rate via channels 108 determines how quickly expansion chamber 106 can be filled, and hence the actuation speed of actuator cell 100. For a channel of diameter d, the electroosmotic pumping flow rate can be defined by the following Equation (1):

$$\dot{V} = \frac{\pi d^2 \varepsilon \varsigma |E|}{\mu},$$

where $\dot{V}$ is the volume flow rate (volume per second, units m$^3$/s), $\epsilon$ is the dielectric constant of the liquid (C/Vm), $\zeta$ is the zeta potential (V), E is the electric field (V/m), and $\mu$ is the viscosity of the liquid (Ns/m$^2$). The zeta potential quantifies the strength of the Debye double layer and varies according to the liquid and solid materials and the surface preparation. The fabrication of micro-channels by chemical etching can create a larger number of dangling bonds and lead to a higher zeta potential then fabrication by heat molding.

For a typical zeta potential of 0.1 volts, using a typical dielectric polar liquid in a one centimeter long, one micrometer diameter channel with an electric field well below dielectric breakdown, the flow rate can be defined by the following Equation (2):

$$\dot{V}=\pi(d=10^{-6}\,\mathrm{m})^2(\epsilon=10^{-9}\,\mathrm{C/Vm})(\zeta=1\mathrm{V})(|\vec{E}|=10^6\,\mathrm{V/m})/(\mu=10^{-3}\,\mathrm{Ns/m^2})=10^{-12}\,\mathrm{m^3/s}.$$

At this rate, it takes approximately $10^4$ seconds, or about 3 hours, to fill a 100 μm×1 cm×1 cm $=10^{-8}$ $m^3$ expansion chamber, such as chamber 106 of FIG. 2B. However, since it is as easy to fabricate many channels in parallel as it is to fabricate a single channel, by creating, for example, 5000 channels between the supply and expansion chamber, the expansion time can be reduced to approximately 2 seconds. Since each channel is only 1 μm thick ($1/1000^{th}$ of a mm), the 5000 channels can be easily fabricated within a 1 cm wide footprint. This also means that cell 100 will continue to function even if many of the channels get clogged.

Yet another way to increase the speed of volume flow rate via channels 108 is to use wider/deeper channels. For example, increasing the diameter d by a factor of two will increase the actuation speed and decrease the pressure, both by a factor of four.

Electroosmotic Pressure: Achievable Stress in the Material

For a channel 108 driven by a pressure difference ΔP, the flow rate can be defined by the following Equation (3):

$$\dot{V}=\pi d^4 \Delta P/8\ \mu l,$$

where the pressure ΔP would be caused by the elastic restoring force in the material and by any applied external load. Setting the electro-osmotic and pressure flow rates equal to one another yields the following Equation (4) for the pressure required to block the electro-osmotic flow:

$$\Delta P \sim l\epsilon\zeta|\vec{E}|/d^2,$$

This pressure corresponds to the maximum stress level that can be achieved at the cavities. Thus the achievable stress in the material increase linearly with the length of channel 108, the electric field, and the zeta potential, and it is inversely proportional to the cross-sectional area of the channel.

Therefore, for actuator cell 100 described above, it is possible to achieve cavity stresses in the tens of mega-Pascals using channel 108 with one micron diameters. Dielectric polar liquids with dielectric constant $\epsilon \sim 100\epsilon_o$, $\epsilon_o=8.854\times 10^{-12}$ C/Vm are available. In approximately 1 cm long by 1 μm diameter channels, an electric field well below dielectric breakdown ($E\sim 10^6$ V/m), and surface treatments to create reasonable zeta potentials, the achievable pressures can be defined by the following Equation (5):

$$\Delta P \sim (l=10^{-2}\ m)(\epsilon=10^{-9}\ C/Vm)(\zeta=1\ V)(|E|=10^6\ V/m)/(d=10^{-6}\ m)^2=10^7\ Pa.$$

The dielectric constant ϵ can be further increased by adding cellulose particles to the fluid that will polarize under an electric field. This will further increase the pressures that are generated.

Material Elasticity and Network Configuration: Achievable Strain

The corresponding achievable strain can be determined by the stiffness of the material. The micro-meter diameter channels 108 can generate pressures in the tens of mega-Pascals at the expansion chambers ($\Delta P\sim 10^7$ Pa). The deformation at chambers 104, 106 will then scale as $d\sim\Delta P/G$ where d is the percent strain, ΔP is the stress, and G is the Young's modulus of the material. Assuming that the net strain in the material is about $1/10^{th}$ the strain generated locally at each expansion chamber, a Young's modulus of $G\sim 10^7$ Pa would yield a 10% material strain. This modulus corresponds to a rubber or to a low density polyethylene. If the Young's modulus is chosen at a lower value, the same stress will achieve an even greater strain. Therefore, for a Young's modulus on the order of $G\sim 10^6$ Pa the expected strain would be between 30% to 100%.

Energy Density Bandwidth, and Power Density

The energy density of actuator cell 100 can be given by σϵ where σ is the stress (units Pa=N/$m^2$) and ϵ is the strain (non-dimensional) of the material. As discussed above, the achievable stress can be $10^7$ Pa, and the achievable strain for robust materials such as rubber, polyethylene, or PMMA, can be on the order of 10% to 30%. Thus the energy density can be on the order of $10^6$ J/$m^3$. It should be noted that this is the energy density of an actuator cell 100 as a whole, not the energy density of stand alone chambers.

The bandwidth of actuator cell 100 or the fluidic actuator material is determined by the amount of time it takes to fill and empty the chambers. This time can be on the order of 2 seconds or 0.5 Hz.

Lastly, the power density can be the energy density per unit time. Since cell 100 or the fluidic actuator material actuates in about 2 seconds, the power density can be the energy density divided by 2 seconds. Using an average 20% strain number yields a power density of $10^6$ W/$m^3$.

The fabrication of actuator cell 100 will now be described in detail.

Table I below summarizes some of the pertinent dimensions and metrics of an exemplary actuator cell 100. The depth of the channels and chambers is ~20 μm.

TABLE I

| | |
|---|---|
| Microchannels | |
| Width | 2 microns |
| Length | 1 centimeter |
| Number | 50 |
| Supply reservoirs | |
| Length | 4.6 millimeters |
| Width | 4.6 millimeters |
| Expansion chambers | |
| Length | 2.0 millimeters |
| Width | 4.6 millimeters |
| Electrode contact pads | |
| Length | 1.5 millimeters |
| Width | 1.5 millimeters |
| Electrode interconnects | |
| Width | 750 microns |
| Length | 4.6 millimeters |

Actuator cell 100 may be fabricated of materials such as silicon, silicon dioxide, 3108/platinum composites, and PDMS.

Figure 8A:
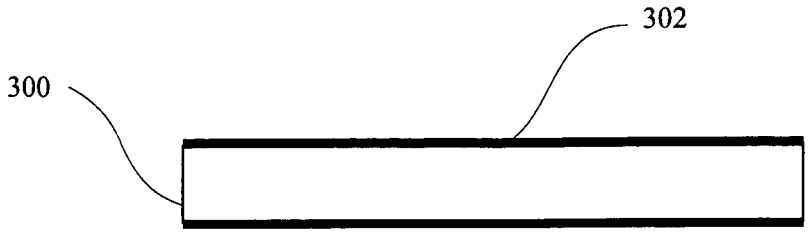
FIGS. 8A-8K provide various illustrations of the manufacturing process for the actuator cell according to the present invention.

As shown in FIG. 8A, the first step may include beginning with a first silicon wafer 300 with a 2-micron thick silicon dioxide layer on each side. One side of the wafer may be polished, with the polished side being referred to as front-side 302.

The second step may include covering the entire front-side 302 of the wafer with hexamethyldisilazane (HMDS) 304. After waiting one minute, the wafer may be spun at 3000 rpm on a spin-coater for 30 seconds. The HMDS serves as an adhesion promoter between the silicon dioxide and photoresist.

Figure 8B:
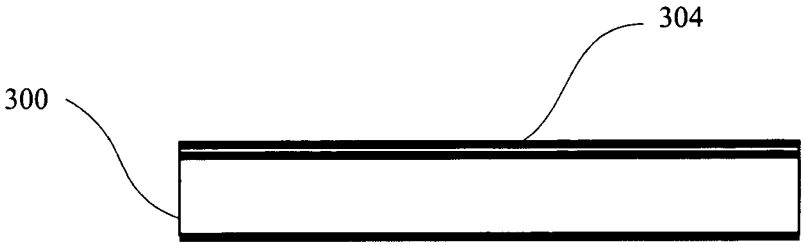

Referring to FIG. 8B, the third step may include covering ⅔ of the front-side of the wafer with 1813 photoresist (Shipley, Inc.) 304, and then spinning at 3000 rpm for 30 seconds. This photoresist layer can be 1.3 microns thick, and will serve as the etch mask during the etching of the silicon dioxide layer. The wafer may then be soft baked on a hot plate, front-side up, at 100° C. for one minute.

Figure 8C:
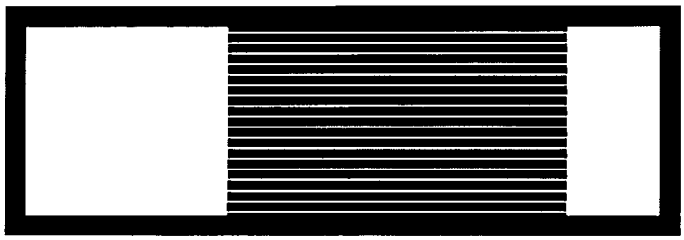

The fourth step may include aligning a mask (as shown in FIG. 8C) delineating the microchannels and reservoirs with the wafer using a mask aligner, and then exposing the resist to ultraviolet light to 8.6 $mW/cm^2$ for 23 seconds (the time depends on the power flux of the mask aligner). The deposited photoresist can be removed in regions where the mask is clear, and it will remain where the mask is dark.

Figure 8D:
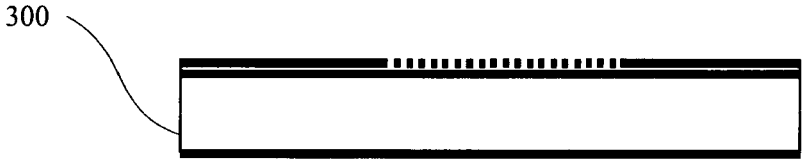

Referring to FIG. 8D, the fifth step may include developing the photoresist in, for example, CD-30 developer for approximately 30 seconds. The completion of the development can be judged visually. The wafer can then be hard baked, front-side up for 10 minutes at approximately 110° C.

Figure 8E:
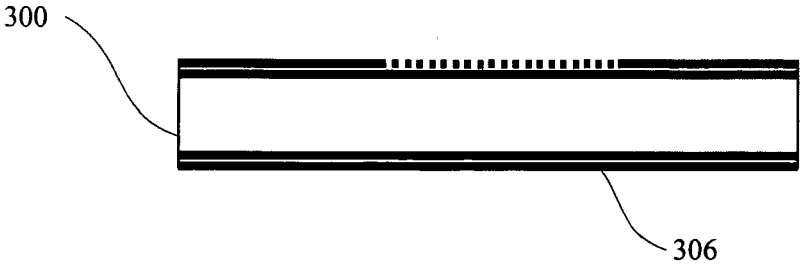

Referring to FIG. 8E, the sixth step may include covering ⅔ of the back-side of the wafer with 1813 photoresist (Shipley, Inc.) 306, and then spinning at 3000 rpm for 30 seconds. This serves to protect the silicon dioxide layer on the back side during the subsequent etching of the oxide on the front side. The wafer can then be hard baked, back-side up for 10 minutes at approximately 110° C.

Figure 8F:
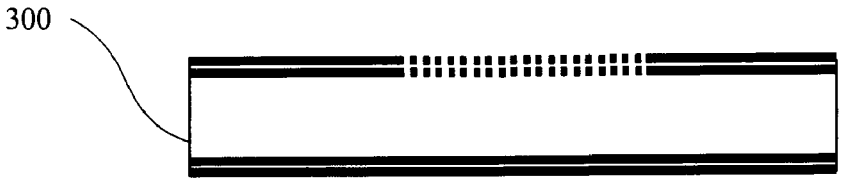

As shown in FIG. 8F, for the seventh step, the exposed silicon dioxide can be wet etched using 49% buffered hydrofluoric acid (available from Transene). This step can take five to ten minutes. The completion of the etch step can be observed through a change in the surface characteristics of the wafer: silicon dioxide is hydrophobic, and silicon is hydrophilic.

Figure 8G:
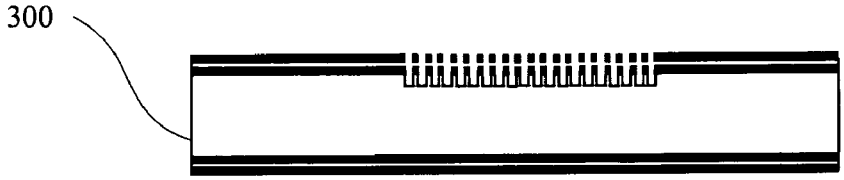

Referring to FIG. 8G, the eighth step may include dry etching the exposed silicon to a depth of 15-25 microns using deep reactive ion etching (DRIE). During DRIE, two gases are alternated: an etch gas, which is $SF_6$, and a passivating gas, which is $C_4F_8$. A possible recipe is a coil power of 600 W, an $SF_6$ flow rate of 130 sccm and a pressures of 33 mtorr pulsed for 9 seconds with a platen RF power of 15 W, alternating with $C_4F_8$ at 80 sccm and 18 mtorr pulsed for 8 seconds with a platen RF power of 0 W. This gives an etch rate of approximately 3 μm/min, so the required etch time can be approximately seven minutes.

Figure 8H:
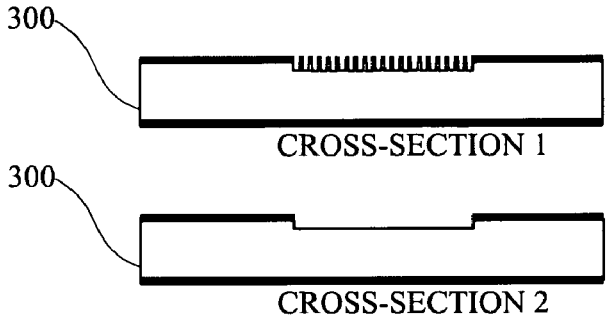
Figure 8H:
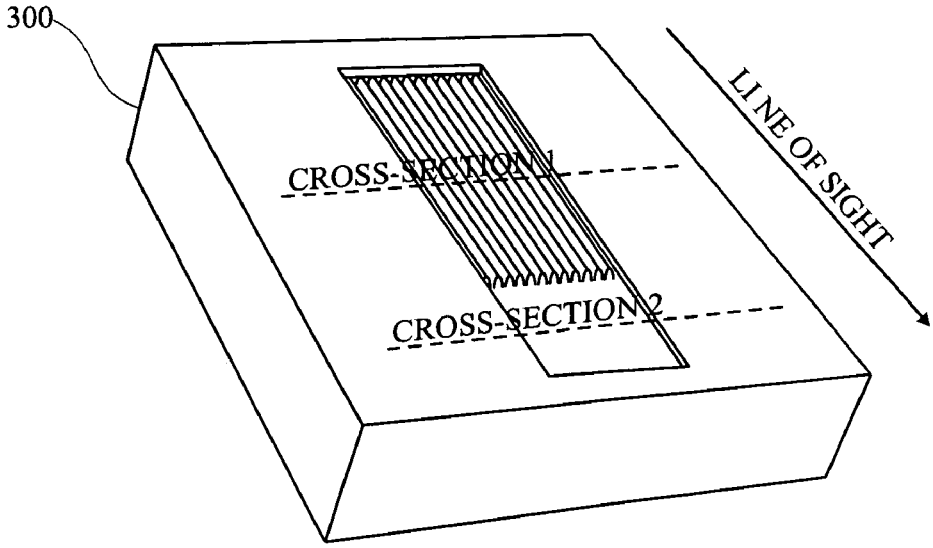

As shown in FIG. 8H, the ninth step may include removing the photoresist layers using stripper (Shipley 1165) to yield the two cross-sectional views shown in FIG. 8H.

The tenth step may include mixing together ten parts Sylgard 184 elastomer base and one part Sylgard 184 hardening agent, and evacuating the air bubbles in a vacuum chamber at 250 torr for 30 minutes (this will cure in the eleventh step to form polydimethylsiloxane (PDMS)).

The eleventh step may include starting with a second wafer; neither the coating, material, nor the orientation are critical for the following steps. For the eleventh step, ⅔ of the front-side of the wafer can be covered with 1813 photoresist (Shipley, Inc.) 304, spun at 3000 rpm for 30 seconds, and soft baked on a hot plate, front-side up, at 100° C. for one minute. After this, ⅔ of the wafer surface can be covered with the mixture created in the tenth step and spun at 6000 rpm for 30 seconds. This will create a film approximately 7 microns thick. The film can be allowed to cure for 24 hours at room temperature to form PDMS, or for less time at higher temperature.

The twelfth step may include covering ⅔ of the PDMS-covered side of the wafer with a mixture of Loctite 3108 and platinum salt, $Pt(NH_3)_4Cl_2$. A possible recipe is 1.36 g of 3108 and 0.47 g of the Pt salt to form a 12% by volume mixture. The mixture may be spun over the PDMS at 7000 rpm for 30 seconds. This will yield a film approximately 12 microns in thickness.

Figure 8I:
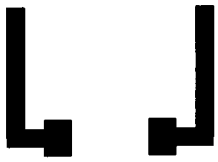

As shown in FIG. 8I, the thirteenth step may include aligning a mask delineating the electrodes with the wafer using a mask aligner, and then exposing the 3108/Pt salt mixture to ultraviolet light for 23 seconds with a power flux of 8.6 $mW/cm^2$ (the time depends on the power flux of the mask aligner). This will turn the 3108 from a liquid to an elastomeric solid at the locations where it is exposed to the UV light.

Figure 8J:
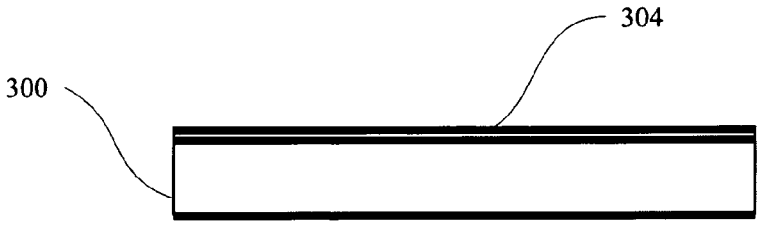

Referring to FIG. 8J, the fourteenth step may include rinsing away the unexposed liquid 8108/Pt salt residue with alternating jets of acetone and deionized water followed by isopropanol.

The fifteenth step may include immersing the second wafer with the PDMS membrane and the attached patterned 8108/Pt salt composite into a solution of 450 mL deionized water and 500 mg of sodium borohydride to chemically reduce the platinum salt. A possible recipe includes immersion in the solution for 5 hours at 60° C. This converts the Pt salt into Pt metal, and makes the composite conducting.

The sixteenth step may include oxidizing the surfaces of the PDMS and Loctite 3108 with oxygen plasma by reactive ion etching (RIE) in order to permanently bond the PDMS membrane and composite electrodes onto the surface of the microchannels. A possible recipe can include exposure to oxygen plasma for 20 seconds at a pressure of 1000 millitorr, a power of 20 Watts, and an oxygen concentration of 100 sccm.

Figure 8K:
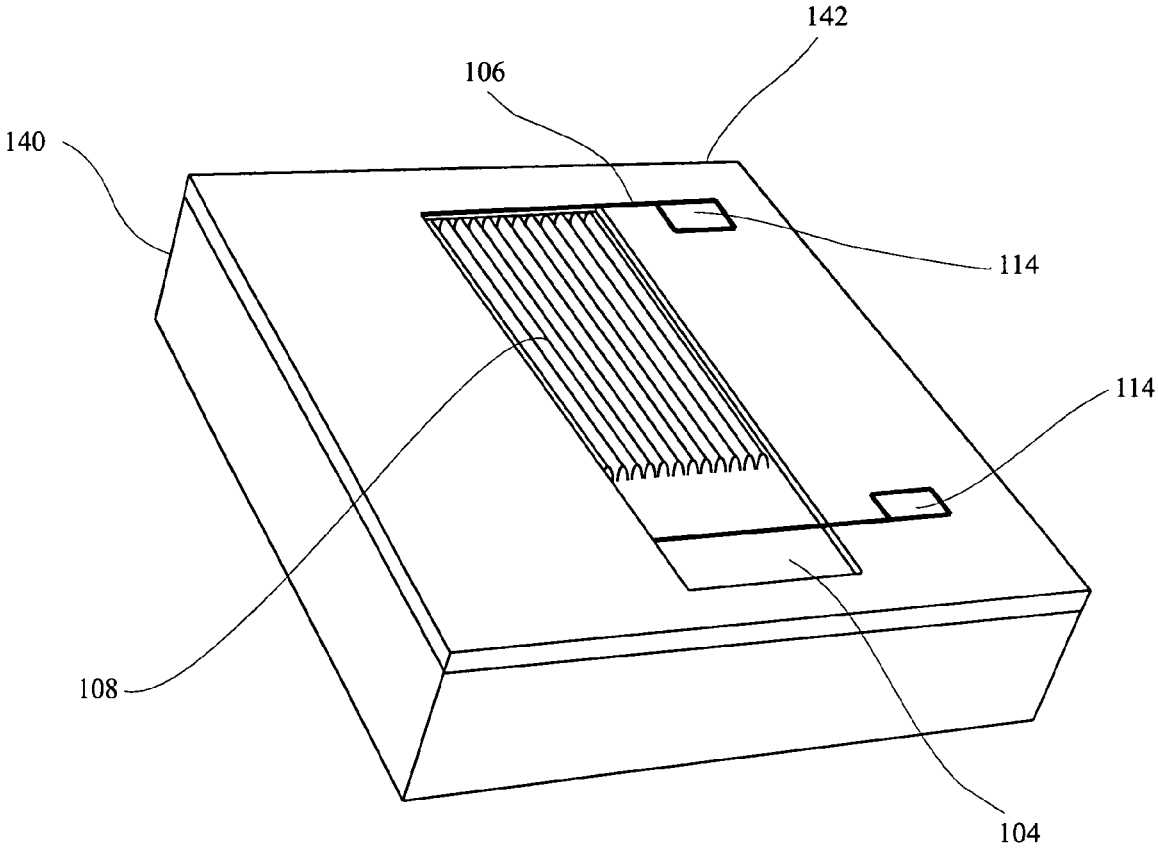

Referring to FIG. 8K, the seventeenth step may include, immediately after removing the wafer from the RIE, placing the front-side face of the second wafer in conformal contact with the front-side face of the first wafer containing the microchannels. The wafers may then be placed on a hot plate at approximately 100° C. for 10 minutes to ensure complete bonding. The second wafer can be removed by sonicating the sandwich in acetone to remove the photoresist between the PDMS and the second wafer, leaving the PDMS bonded to the first wafer.

It should be noted that the aforementioned manufacturing steps for actuator cell 100 are provided for exemplary purposes only, and those skilled in the art would readily appreciate that various modifications may be made without departing from the scope of the present invention.

Figure 9:
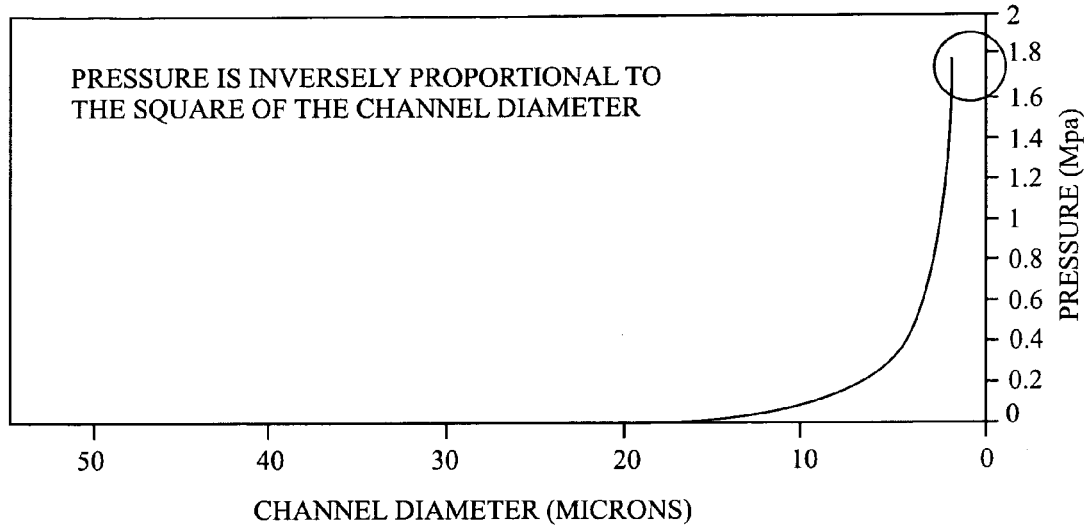
FIG. 9 is a graph illustrating the expected performance for the present invention actuator cell.
Figure 10:
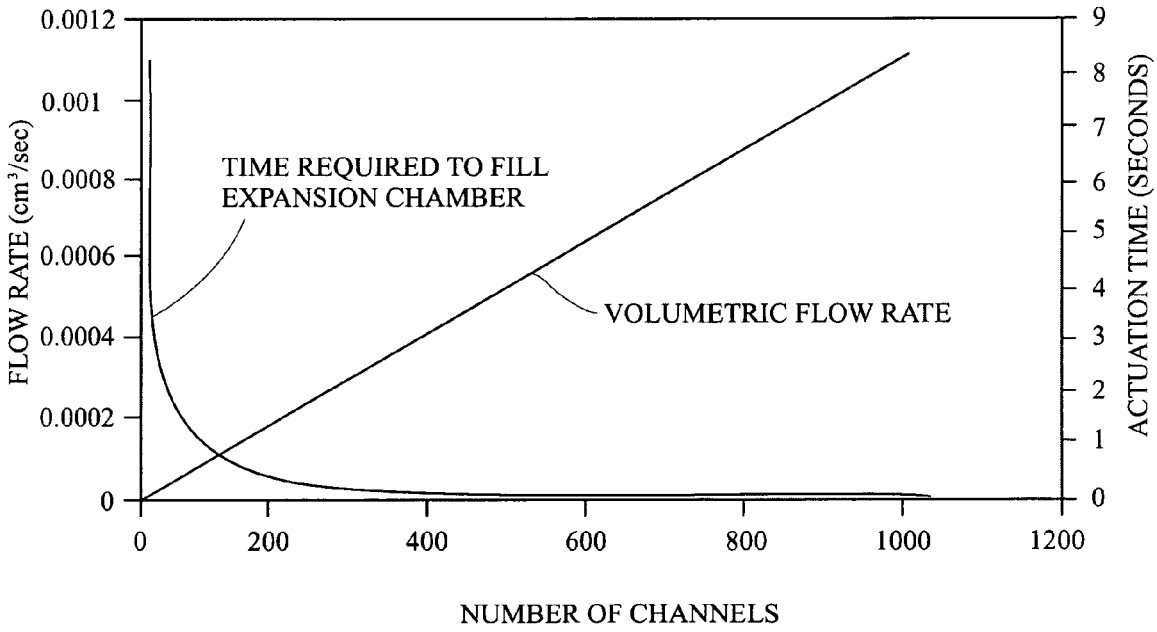
FIG. 10 is a graph illustrating the amount of time it takes for an expansion chamber to fill with electrolytic fluid in a typical actuator cell.

Referring to FIG. 9, the expected performance for actuator cell 100 is illustrated. As illustrated in FIG. 9, a microchannel diameter of 2 microns will create a pressure of approximately 2 MPa in the expansion chamber. Because the Young's modulus of the PDMS membrane is only 1 MPa, this will allow for significant mechanical deformation or actuation. The achievable pressure can be increased by decreasing the width of the microchannels.

Another important performance metric is the amount of time needed for cell 100 to actuate. For actuator cell 100 described above, as shown in FIG. 10, this corresponds to the amount of time it takes for the expansion chamber to fill with the electrolytic fluid. Based on the dimensions summarized above in Table I, in an exemplary cell 100 including 50 channels connecting the reservoirs, the cell will need about 2 seconds to completely fill the expansion chamber. This actuation time can be decreased simply by increasing the number of channels connecting the two reservoirs.

To summarize, for the present invention, electroosmotic pumping causes large expansions of the expansion chambers, and thus large deformations of cells 100 or the fluidic actuator material at high pressure.

Actuator cell 100 and the fluidic actuator material thus provide an actuation apparatus and method utilizing electric-field driven pumping for generating stresses and strains that are capable of exceeding those generated by conventional muscle-like actuators, such as, piezoelectric, shape memory alloys (SMA), and dielectric elastomers (DEA). Actuator cell 100 and the fluidic actuator material can also be applicable in a variety of fields, such as mechanics (i.e. robust snake-like crawling robots, and quiet/stealthy manta ray swimming vehicles), animatronics, robotics, and aerodynamics (i.e. shape changing wings for unmanned air vehicles), and a host of other fields which utilize stress and/or strain actuators.

Although the invention has been described based upon these preferred embodiments, it would be apparent to those of skilled in the art that certain modifications, variations, and alternative constructions would be apparent, while remaining within the spirit and scope of the invention. In order to determine the metes and bounds of the invention, therefore, reference should be made to the appended claims.

What is claimed is:

1. A fluid-filled actuator cell comprising:

a contractible supply chamber;

at least two expansion chambers for receiving fluid from said supply chamber;

at least one channel providing a fluid flow passage between said supply and expansion chambers;

a compliant material bounding at least partially said supply and expansion chambers; and an electric circuit for applying an electric field across said supply and expansion chambers, and thereby causing fluid flow from said supply to said expansion chambers.

2. A fluid-filled actuator cell comprising:

a contractible supply chamber;

an expansion chamber for receiving fluid from said supply chamber;

at least one micro-channel or nano-channel providing a fluid flow passage between said supply and expansion chambers;

a compliant material bounding at least partially said supply and expansion chambers; and an electric circuit for applying an electric field across said supply and expansion chambers, and thereby causing fluid flow from said supply to said expansion chamber.

3. An actuator cell according to claim 2, wherein said electric circuit includes compliant (STRETCHABLE) electrodes connected to said supply and expansion chambers.

4. An actuator cell according to claim 2, wherein said fluid is one of a polar liquid, a dielectric liquid, a salt-containing liquid, an acid, and a base.

5. A method of actuating comprising:

providing a first actuation cell;

providing an electric field across supply and expansion chambers of said actuation cell, thereby causing fluid flow from said supply chamber to said expansion chamber; and providing a micro-channel or a nano-channel for fluid flow from said supply chamber to said expansion chamber.

6. A method according to claim 5, further comprising providing said electric field by an electric circuit including compliant electrodes connected to said supply and expansion chambers.

7. A method according to claim 5, wherein said fluid is one of a polar liquid, a dielectric liquid, a salt-containing liquid, an acid, and a base.

8. A method of making a device for actuation, comprising:

fabricating at least one expandable expansion chamber, at least one contractible supply chamber, and at least one micro-channel or nano-channel connecting said expansion and supply chambers;

fabricating an electrode in the expansion chamber and an electrode in the supply chamber; and providing an electric circuit for generating an electric field across said supply and expansion chambers for thereby causing fluid flow from said supply chamber to said expansion chamber.

9. A shape-changing fluidic actuator material comprising:

a substantially elastomeric material containing a plurality of fluid-filled actuator cells, each including:

at least one contractible supply chamber;

at least one expansion chamber for receiving fluid from said supply chamber;

at least one channel providing a fluid flow passage between said supply and expansion chambers; and a compliant material bounding at least partially said supply and expansion chambers;

the fluidic actuator material further comprising:

an electric circuit for applying specified electric fields across the actuator cells, thereby causing a specified amount of fluid flow from the supply chamber to the expansion chamber, whereby actuation of the actuator cells results in the fluidic actuator material changing shape.

10. A fluidic actuator material according to claim 9, wherein said actuator cells are individually addressable, whereby applying different specific electric fields across different specific actuator cells causes the actuator material to take on different shapes.

11. A fluidic actuator material according to claim 9, wherein said actuator cells are of different types, whereby the actuator material can be made to take on predetermined shapes that could not be achieved with actuator cells of the same type, including at least one of bending, twisting, shortening, lengthening, bulging and dimpling.

12. A method of actuating comprising:

providing a first actuation cell within a fluidic actuator material;

providing an electric field across supply and expansion chambers of said actuation cell, thereby causing fluid flow from said supply chamber to said expansion chamber; and providing a second actuation cell and a means for applying different voltages across said first and second actuation cells, whereby different deformations of the fluidic actuator material can be achieved by altering the voltages applied to said first and second actuation cells.

13. A method of actuating comprising:

providing a first actuation cell within a fluidic actuator material;

providing an electric field across a supply chamber and at least two expansion chambers of said actuation cell, thereby causing fluid flow from said supply chamber to said expansion chambers;

whereby a deformation of the fluidic actuator material can be achieved.

14. An actuator comprising a fluid-filled actuator cell, said cell comprising:

a contractible supply chamber;

an expansion chamber for receiving fluid from said supply chamber;

at least one micro-channel or nano-channel providing a fluid flow passage between said supply and expansion chambers;

a compliant material bounding at least partially said supply and expansion chambers; and an electric circuit for applying an electric field across said supply and expansion chambers, and thereby causing fluid flow from said supply to said expansion chamber.

* * * * *